US006962336B2

(12) United States Patent
Glass

(10) Patent No.: US 6,962,336 B2
(45) Date of Patent: Nov. 8, 2005

(54) CREDIT CARD DEBT MANAGEMENT BOARD GAME

(76) Inventor: Mechel Glass, 3463 N. Field Way, NW., Kennesaw, GA (US) 30144

( * ) Notice: Subject to any disclaimer, the term of this patent is extended or adjusted under 35 U.S.C. 154(b) by 0 days.

(21) Appl. No.: 10/374,816

(22) Filed: Feb. 25, 2003

(65) Prior Publication Data

US 2004/0164490 A1 Aug. 26, 2004

(51) Int. Cl.[7] ..... A63F 3/00
(52) U.S. Cl. ..... 273/256; 273/278
(58) Field of Search ..... 273/256, 278

(56) References Cited

U.S. PATENT DOCUMENTS

| | | | | |
|---|---|---|---|---|
| 3,807,739 A | | 4/1974 | Henley et al. | |
| 4,053,157 A | | 10/1977 | Cowan | |
| 4,440,397 A | | 4/1984 | Butner | |
| 4,522,407 A | | 6/1985 | Hatherley | |
| 4,890,843 A | | 1/1990 | Chauve | |
| 4,955,616 A | | 9/1990 | Ingalls | |
| 5,071,135 A | * | 12/1991 | Campbell | 273/256 |
| 5,139,268 A | * | 8/1992 | Garnett | 273/249 |
| 5,407,207 A | | 4/1995 | Stanford | |
| 5,660,390 A | * | 8/1997 | Ginzburg et al. | 273/257 |
| 5,788,235 A | | 8/1998 | Thomas | |
| 5,826,878 A | | 10/1998 | Kiyosaki et al. | |
| 6,032,957 A | | 3/2000 | Kiyosaki et al. | |
| 6,106,300 A | * | 8/2000 | Kiyosaki et al. | 434/107 |

OTHER PUBLICATIONS

Ex.Parte Breslow 192 USPQ 431.*

* cited by examiner

*Primary Examiner*—Vishu K. Mendiratta
(74) *Attorney, Agent, or Firm*—Thomas R. Williamson III; Joel D. Myers; Myers & Kaplan, LLC

(57) ABSTRACT

A board game comprising a board with a path having spaces thereon, wherein the path is navigated around the board by rolling dice, with the purpose being to teach the management and elimination of credit card debt. The game incorporates real life situations requiring the increase of debt due to both external events and personal choices, and further permits the use of discretionary income to decrease credit card debt, and subsequently the accumulation of wealth.

19 Claims, 5 Drawing Sheets

CREDIT CARD DEBT MANAGEMENT BOARD GAME

COPYRIGHT NOTICE AND LIMITED AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present invention relates generally to an apparatus and method for learning to manage credit card debt. More particularly, the present invention is directed to a board game utilized to teach game players credit card debt management.

BACKGROUND OF THE INVENTION

The present invention arose out of a need for a device and method to enable the teaching of credit card debt management to consumers. Credit card debt is a significant portion of debt accumulated by individuals, many of whom allow credit card debt to surpass their ability to service that debt.

At present, there are various board games available that involve teaching debt and asset accumulation. However, many such games possess inherent disadvantages when compared to the present invention:

U.S. Pat. No. 6,106,300 to Kiyosaki et al. teaches a game for learning financial skills with investment goals and liability goals. The game has cards to determine effects of play. The game uses real-life situations, but is geared toward children. Generation of passive income in excess of expenses is the goal. Cash flow management is a requirement. The game uses everyday life expenses that one might incur. While liabilities are part of the game, the generation of passive income is the principal purpose, and credit card debt, and the reduction thereof, is not part of the play of the game. Furthermore, the game is geared toward children who, typically, do not have the debt management concerns of the average adult in real debt situations.

U.S. Pat. No. 6,032,957 to Kiyosaki et al. teaches a game, based on personal financial wealth accumulation. The game is geared to more high-end sophisticated players, involving franchises, business purchases, and the like. Each player also has a profession. There are two stages of play; moving to the second stage is based on passive income exceeding personal expenses. Although the Kiyosaki et al. '957 patent has geared the game toward adults, it requires a high level of financial sophistication to play, and is, again, geared to generation of passive income, instead of debt reduction.

U.S. Pat. No. 5,826,878 to Kiyosaki et al. teaches much the same game as the '957 patent and has the same limitations.

U.S. Pat. No. 5,788,235 to Thomas teaches a business related board game with the goal of purchasing businesses. Purchases can be made jointly between the players, or individually. The game is quite specific to business environment simulation, rather than debt, management. The goal of the game is wealth accumulation. As such, the Thomas '235 patent does not relate to credit card debt, but rather to the acquiring of businesses.

U.S. Pat. No. 5,407,207 to Stanford teaches a game that simulates lifetime events as one progresses through the different ages of life, wherein the game terminates at a predetermined age, and is essentially based on business acquisitions and job categories. Borrowing is an integral part of the game. The Stanford '207 patent is geared toward the purchasing and operation of a business, but offers no means to learn credit card debt management.

U.S. Pat. No. 5,071,135 to Campbell teaches financial management principles, mainly the buying and selling of stock, personal expense management and income from salary, wherein the game is based on a starting age. The game is played on calendar year quarters with the object to build the greatest net worth. Loans between players are permitted. Campbell '135 also deals with the handling of spectacular financial events such as floods and earthquakes, while building wealth through playing the lottery or other means. It does not enable the learning of credit management principles, however.

U.S. Pat. No. 4,955,616 to Ingalls teaches a game involving education, family, business, political and financial events of life. Achieving a predetermined balance determines the winner. The game involves savings account building. Although the game principles of Ingalls '616 focus on reaching an adequate asset level to go into retirement, it fails to offer an opportunity to learn credit card debt management.

U.S. Pat. No. 4,890,843 to Chauve teaches a game involving geographical locations, gambling, travel and sporting events. While this game has cards called "credit cards", they are cards that are drawn by a player that involve various credit situations unrelated to typical credit card transactions.

U.S. Pat. No. 4,522,407 to Hatherley teaches financial board game with political scenarios that, collectively, simulate a free market economy. The attainment of loans is an important factor in the game. Hatherley '407 is geared toward corporate takeovers and political factors and does not enable learning of credit card debt management.

U.S. Pat. No. 4,440,397 to Butner teaches taxation principles and tax laws, not credit card debt management. The game ends after a specified period, with the winner being the one with the most money.

U.S. Pat. No. 4,053,157 to Cowan teaches a game to accumulate a minimum level of total assets and achieve zero liability balance, wherein some real life situations are a part of the game. However, the game of Cowan '157 does not utilize credit cards, nor does it enable the learning of management of credit card debt.

U.S. Pat. No. 3,807,739 to Henley teaches a game involving stock, real estate, loans and insurance, with the object to build equity. The game ends when a player declares bankruptcy. The end result of the game of Henley '739 being apposite the risks of not managing debt, demonstrates a need for a means for learning debt management skills, but does not facilitate the goal of learning to manage credit card debt.

While some or all of the above referenced patents may well be used for learning about debt and asset accumulation, they fail to adequately teach management of credit card debt and are overly complicated.

Therefore, it is readily apparent that there is a need for a credit card management board game that teaches players to make wise choices in managing their credit card debt.

BRIEF SUMMARY OF THE INVENTION

Briefly described, the present invention overcomes the above-mentioned disadvantages and meets the recognized need for such a device by providing a credit card debt management board game for teaching credit card debt management.

According to its major aspects and broadly stated, the present invention in its preferred embodiment is a board game comprising a board with a path having spaces thereon, wherein the path is navigated around the board by rolling dice, with the purpose being to teach the management of credit card debt.

More specifically, the present invention is a game which incorporates real life situations requiring the increase of debt due to both external events and personal choices, and allows the use of discretionary income to decrease credit card debt, and to subsequently accumulate wealth.

The present invention relates to a device that could be used for teaching individuals how to eliminate their credit card debt.

Accordingly, a feature and advantage of the present invention is its ability to teach adults and children how to manage their credit card debt.

A further feature and advantage of the present invention is its ability to provide a road map for the accumulation of wealth and the elimination of credit card debt.

A feature and advantage of the present invention is its ability to be utilized by educational facilities or by individuals.

A further feature and advantage of the present invention is that it is simple to manufacture and of low cost.

A further feature and advantage of the present invention is that it can be utilized to teach cash flow management.

Another feature and advantage of the present invention is that it differs significantly from other games, since players of the instant game will begin with different amounts of debt and different amounts of cash.

A feature and advantage of the present invention is that it assists individuals to relieve themselves of debt.

An additional feature and advantage of the present invention is that it is fun to play.

These and other objects, features and advantages of the present invention will become more apparent to one skilled in the art from the following description and claims when read in light of the accompanying drawings.

BRIEF DESCRIPTION OF THE DRAWINGS

Figure 1:
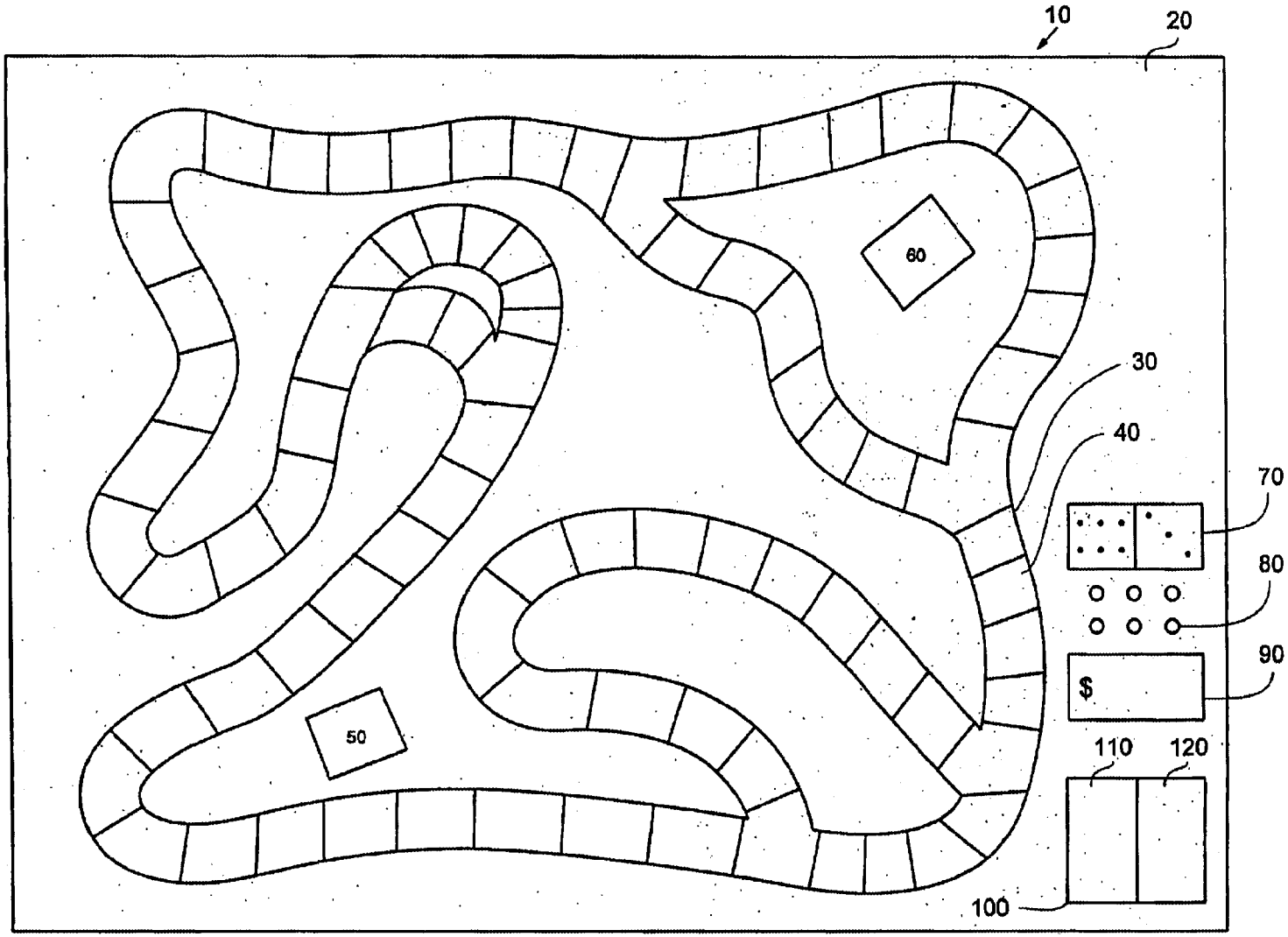

Having thus described the invention in general terms, the present invention will be better understood by reading the Detailed Description of the Preferred and Alternate Embodiments with reference to the accompanying drawing figures, which are not necessarily drawn to scale, and in which like reference numerals denote similar structures and refer to like elements throughout, and in which:

FIG. 1 is a top plan view of a board for play according to the preferred embodiment of the present invention.

Figure 2:
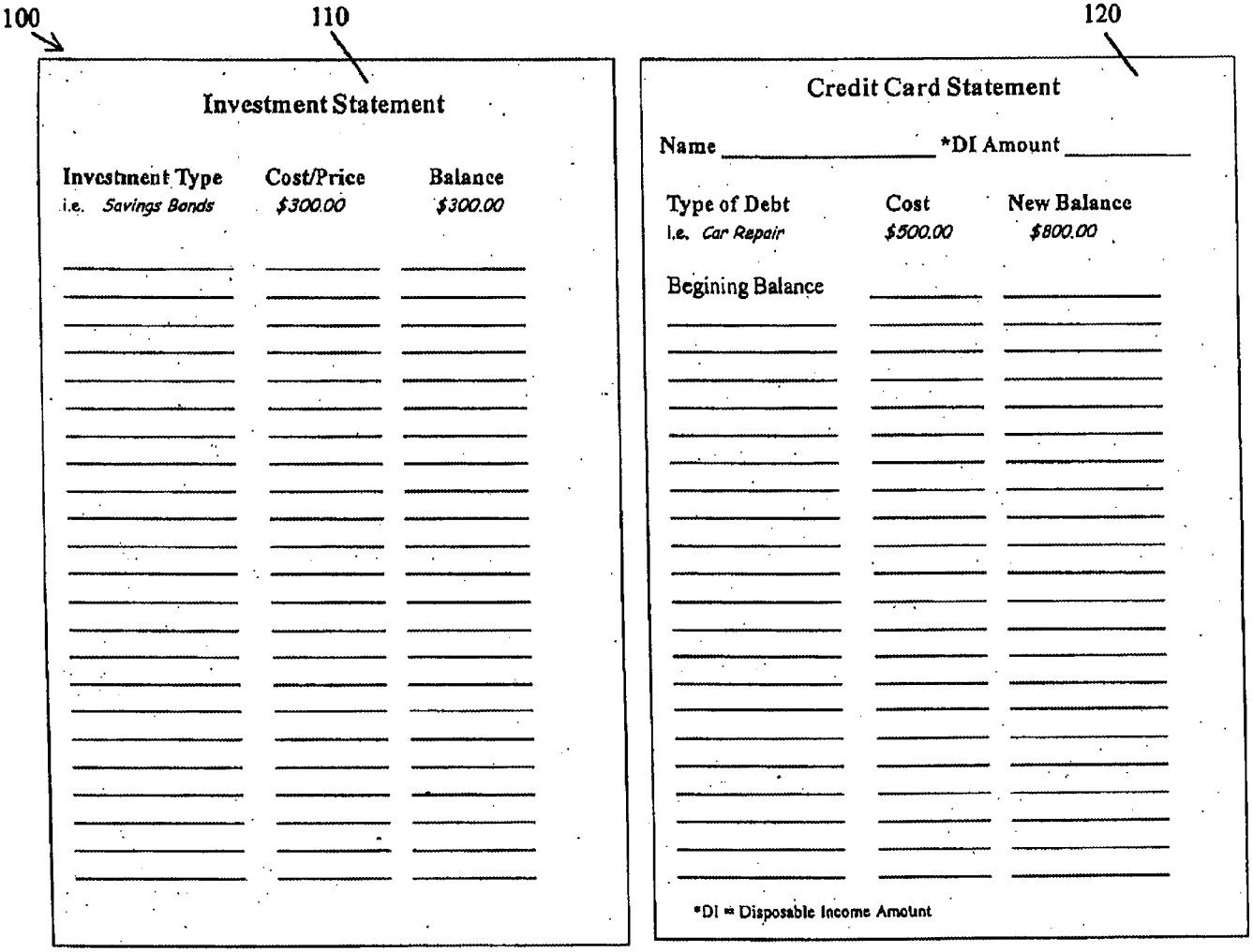

FIG. 2 depicts a scorecard of the preferred embodiment of the present invention.

Figure 3:
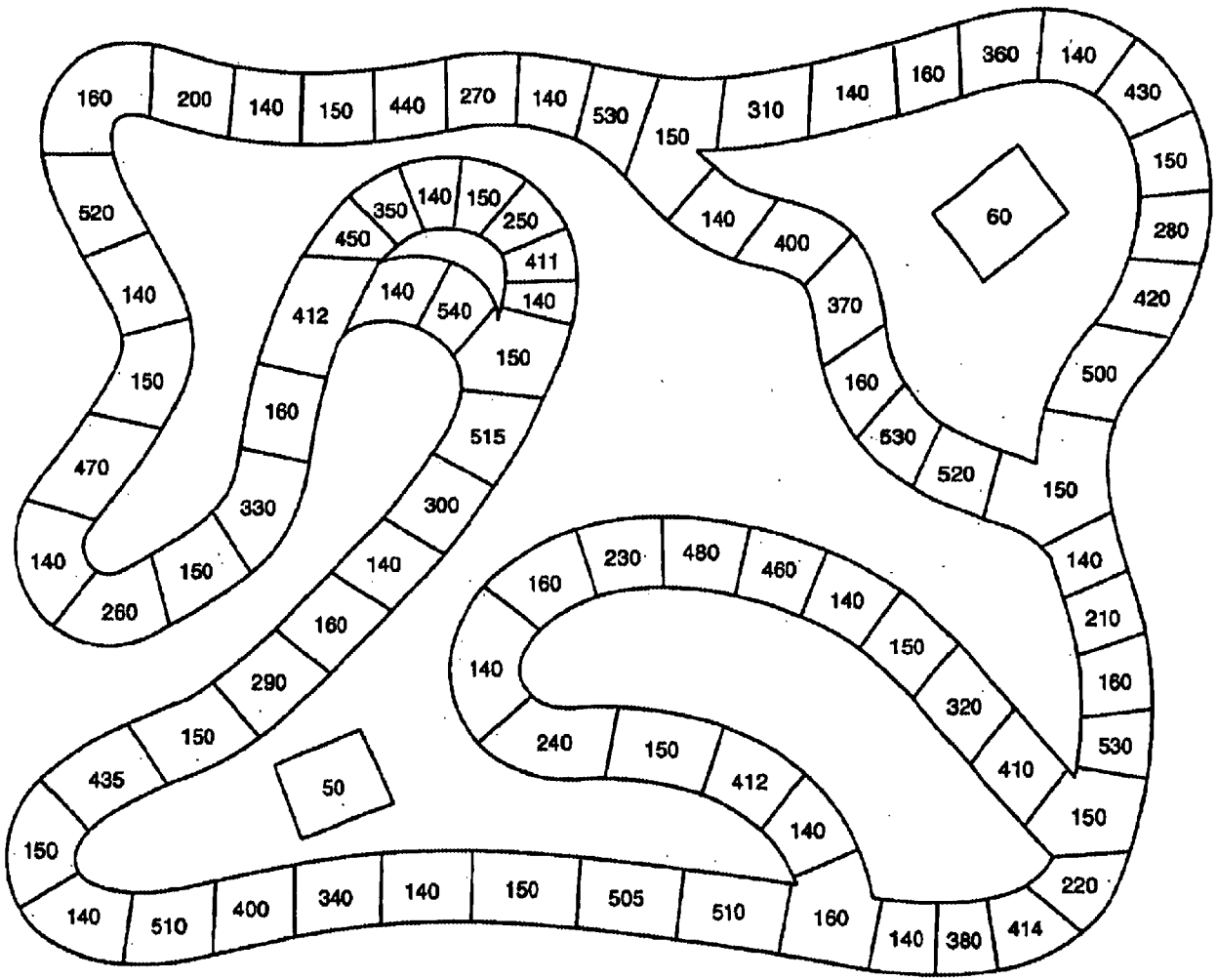

FIG. 3 depicts a more detailed top plan view of the preferred embodiment of the present invention.

DETAILED DESCRIPTION OF THE PREFERRED AND ALTERNATIVE EMBODIMENTS

In describing the preferred and alternate embodiments of the present invention, as illustrated in the Figures, specific terminology is employed for the sake of clarity. The invention, however, is not intended to be limited to the specific terminology so selected, and it is to be understood that each specific element includes all technical equivalents that operate in a similar manner to accomplish similar functions.

The present invention is suitable for providing credit card management skills through game play. Players are preferably given a starting credit card balance and starting cash, which may vary among the players, and are preferably selected by roll of a die. Players then attempt to reduce their credit card debt through appropriate decisions, while at the same time attempting to increase their cash balance. Through the course of play, events occur by moving along a board, sometimes requiring decisions on the part of players, and sometimes forcing certain unforeseen events upon them. Through such play, players will learn to make wise choices, learn different approaches to managing their credit card balances, and learn how to pay off their debt.

Referring now to FIG. 1, game apparatus 10 comprises board 20, having thereon route or path 30 that is followed during play of the game. Preferably route or path 30 possesses spaces 40 marked with certain actions that are to occur during play. Also located on board 20 are rectangles for placement of "Debt" cards 50 or "Your Choice" cards 60. The game preferably commences at square 130.

Play of the Game

In the preferred embodiment of the present invention, game apparatus 10 comprises board 20 with actions thereon listed in spaces 40; two dice 70; six different colored player indicators 80, such as, for exemplary purposes only, trash cans; fifty-five "Your Choice" cards 60; thirty "Debt" cards 50; game money 90 in denominations of, for exemplary purposes only, $10 (thirty of each), $20 (thirty of each), $50 (thirty of each), $100 (fifty of each) and $500 (twenty of each); and scorecard 100, having thereon an area for listing credit card balance 120 and investments 110.

The game may be played individually or with several players up to six. Optimum play is between two to six players.

Play begins with roll of one die 70 to select the starting amount of debt and cash that a player begins with. Differing significantly from other games, players of the instant game will begin with different amounts of debt and different amounts of cash. The amounts of cash and debt equating to various rolls of the die are set forth in TABLE I.

©Mechel Glass

TABLE I

| Count on die | Cash | Credit card balance |
|---|---|---|
| 1 | $300.00 | $900.00 |
| 2 | $400.00 | $1,200.00 |
| 3 | $500.00 | $1,500.00 |
| 4 | $400.00 | $1,200.00 |
| 5 | $300.00 | $900.00 |
| 6 | $500.00 | $1,500.00 |

© 2003 Mechel Glass

After all players have selected their starting cash and debt through roll of a single die, the players mark their cash and debt amounts on scorecard 100.

FIG. 2 shows scorecard 100 having thereon an area for listing investments 110 and area for listing credit card debt 120.

Next, players roll two dice 70 to determine which player will begin the game, with the highest roll of dice 70 going first. In the event of a tie, dice 70 are rolled again.

Play commences with a roll of dice 70 and movement of their game piece by the rolling player. As player moves down route or path 30, player will arrive at typical space 40. Preferably located on typical space 40 is a message calling for an action, wherein the action may be to pay off debt or expenses, receive income, purchase or sell assets, purchase merchandise, or to select a card. On some spaces, the action called for is the selection of a card from one of two different card stacks: "Debt" cards 50, and "Your Choice" cards 60. Preferably, "Debt" cards 50 have thereon various activities depicting real life situations and requiring the payment of expenses and credit card fees and interest. The second category, "Your Choice" cards 60 preferably have different activities with a set of alternatives for each card. During play, when encountering a "Your Choice" card 60, players select the alternative of their choice, thus allowing them to make decisions, such as, for exemplary purposes only, whether to spend cash to purchase a luxury item, or to invest their money.

By permitting players to make their own decisions between controlled alternatives, the present invention affords players a learning opportunity. Players may decide randomly or they may follow a particular strategy. However, any strategy will be complicated by "Your Choice" cards 60 and "Debt" cards 50, which provide for the occurrence of unexpected events that, either have a positive or a negative financial impact on the player.

In the course of play, player will have opportunities to select various actions. For instance, one player might use excess funds to pay off credit cards, while another player may choose to use excess funds for the purchase of investments.

When a player incurs credit card debt of, for exemplary purposes only, $3,000, their choice to invest is taken away, their only permissible action being the service of credit card debt.

As players progress around the board, they encounter spaces calling for new expenses that a player may choose to pay with cash or credit cards, such as, for exemplary purposes only, the purchase of a new automobile tire.

Space 40 may alternatively require the drawing of a card from one of two decks: "Your Choice" cards 60, having thereon two actions, allowing selection of an alternative by the player, or "Debt" cards 50, which immediately require that player incur an unforeseen debt expense and thus increase their credit card balance if they do not have adequate cash to pay the expense.

During travel around the board, players may also select, at various points, different pathways to follow. One pathway may be shorter, having thereon, for exemplary purposes only, higher risk and higher reward spaces 40, or alternatively may be longer, having more risk and reward spaces 40, wherein such spaces 40 would be more moderate in their risks and rewards.

Preferably, a minimum of $500 cash on hand is required in order for a player to be permitted to pay off any credit card debt and at the same time, it must be done at the beginning of player's turn.

Upon receipt of "Your Choice" card 60, a player must make a financial decision. Often a player may be limited in their financial position, and may be forced to take one of the two alternatives due to a lack of the requirements to take the other. If neither alternative is viable, then play passes to the next player in turn.

If a player receives "Debt" card 50, they immediately incur a new debt expense, which must either be paid in cash or placed against the balance on their credit card.

Along board 20, certain spaces 40 provide thereon for the receipt of income. Upon landing on such space 40, player receives the specified income amount from the bank.

If player lands on an Investment space, they may take advantage of the investment, provided they have adequate funds on hand. Investments may not be funded by incurring credit card debt. Furthermore, if a player has more than, for exemplary purposes only, $3,000 in credit card debt, player is prohibited from taking advantage of the investment.

When a player lands on a "Debt" space, they must select a card from the "Debt" card 50 stack and carry out the instructions thereon.

When a player lands on a "Your Choice" space, player must select a card from the "Your Choice" card 60 stack and make a decision between the alternatives thereon.

In the course of travel on path around board 20, player may encounter "Unexpected/Must Pay" spaces, requiring the player to pay for unexpected expenses in cash first, and then, to the extent that cash is lacking, via the player's credit card.

In order to increase available cash, investments may be sold to the bank for a reduced value, for exemplary purposes only, at half the value of the investment, or in the event that another player is willing to purchase the investment, such a transaction may be carried out so long as the amount paid by the other player is the original cost or less.

FIG. 3 depicts the preferred embodiment of the present invention more detail wherein the layout of board 20 has location indicating that "Debt" card selection 140, or "Your Choice" card selection 150 is required. Other locations on board 20 provide players with disposable income 160. Investment actions are identified by reference numerals, which are listed in Table II, along with a description of the legend thereon.

©2003 Mechel Glass

TABLE II

| Reference Numeral | Action |
|---|---|
| 200 | Purchase 5 CDs at $100.00 a piece |
| 210 | Purchase 2 Shares of your company stock at $500 per share |
| 220 | Purchase 5 Bonds at $500.00 total cost |
| 230 | Put $1,000.00 into your retirement account |
| 240 | Purchase 10 CDs for $1,000.00 total |
| 250 | Purchase emerald stones for $1,000.00 |
| 260 | Put $400.00 into a money market account |
| 270 | Put $500.00 into a savings account |
| 280 | Purchase 5 Shares of stock at $100.00 per share |
| 290 | Open a mutual fund for $2,000.00 |
| 300 | Open a child's savings account fund for $400.00 |
| 310 | Open a retirement account for your spouse for $1,000.00 |
| 320 | Purchase a T-Bill for $2,000.00 valued at $3,000.00 |
| 330 | Purchase 10 Shares of your company stock at $50.00 per share |
| 340 | Purchase ½ acre of land for $2,500.00 |
| 350 | Purchase 1 acre of land for $3,000.00 |
| 360 | Open an annuity for $1,500.00 |
| 370 | Open a savings account for $300.00 |
| 380 | Open a mutual fund for $400.00 |

© 2003 Mechel Glass

In addition to the aforementioned spaces 40, there are other locations on board 20 that require payment of expenses and receipt of income. The content of these spaces 40 is shown in Table III along with reference numerals.

©2003 Mechel Glass

TABLE III

| Reference Numeral | Action |
|---|---|
| 400 | Pay bank $50.00 for a speeding ticket (2 spaces) |
| 410 | Pay bank $500.00 for traffic accident |
| 411 | Pay bank $300.00 in late fees for credit card |
| 412 | Pay bank $200.00 in late fees for credit card |
| 414 | Pay bank $100.00 in late fees for credit card |
| 420 | Pay bank $300.00 for dental work |
| 430 | Pay bank $200.00 for late student loan fees |
| 435 | Pay $200.00 for a replacement auto tire |
| 440 | Pay bank 10% of your credit card balance |
| 450 | Pay bank 20% of your credit card balance |
| 460 | Pay bank 30% of your credit card balance |
| 470 | Receive 10% of your investment balance from the bank in cash |
| 480 | Receive 20% of your investment balance from the bank in cash |
| 500 | Receive $100.00 worth of returns, if you own a mutual fund |
| 505 | Pay bank $100.00 in fees if you own a mutual fund |
| 510 | Receive $200.000 worth of profit, if you own any stock |
| 515 | Pay $250.00 in losses, if you own any stock |
| 520 | Receive $50.00 in interest, if you have a savings account (2 spaces) |
| 530 | Receive $100.00 interest, if you own a CD (3 spaces) |
| 540 | Receive $100.00 in returns, if you own a T-Bill |

© 2003 Mechel Glass

Table IV lists the actions required on the set of "Debt" cards 50.

©2003 Mechel Glass

TABLE IV

| Debt Card Legend |
|---|
| Pay $500.00 for car repairs |
| Pay $800.00 for taxes due on property |
| Pay $200.00 for a shopping spree |
| Pay $50.00 for eating out |
| Pay $100.00 for eating out |
| Pay $150.00 for eating out |
| Pay $600.00 for child's braces |
| Pay $200.00 for new designer reading glasses |
| Pay $3,000.00 for room addition |
| Pay $2,500.00 for down payment on a new car |
| If you have a credit card balance, pay $200.00 in late fees |
| Pay $400.00 rental car fees |
| Pay $2,000.00 for a European vacation |
| Pay $900.00 for a 2-day Caribbean cruise |
| Pay $1,000.0 for supplies at home improvement center |
| Pay $500.00 for plumbing repairs on the house |
| Pay $150.00 for child's school supplies |
| If you have a credit card balance, pay $50.00 in late fees |
| If you have a credit card balance pay 10% interest on credit card balance, with a minimum payment of $100.00 |
| If you own any land, pay taxes due on the land of $500.00 |
| If you have any stock, pay commission fee's of $300.00 |
| If you own any CDs pay $100.00 fee to the bank. |
| Pay $300.00 for antique doll, later found to be worth only $12.00 |
| Pay $300.00 for child's field trip |

TABLE IV-continued

| Debt Card Legend |
|---|
| Pay $1,500.00 for a new home theater |
| Pay $200.00 for dinner at a 5-star restaurant |
| If you own an annuity, pay $100.00 in commission fees |
| If you own any investments, pay the bank $300.00 |
| Pay $400.00 for "rare" painting, later to be found to be worth only $20.00 |
| If you own any T-Bills, pay the bank $200.00 in fees |

© 2003 Mechel Glass

Table V lists the choices permitted on the "Your Choice" cards 60.

©2003 Mechel Glass

TABLE V

| Your Choice (55) Cards |
|---|
| 1. Your Choice, go on a shopping spree spending $500.00 on a fabulous sale or you can roll the dice again at a cost of $200.00. |
| 2. Your Choice, talk a neighbor into selling one of their investments to you at cost or you can go to the first debt space on the board. If you neighbor will not sell to you, you must move to the first debt space closest to you on the board and do what it says. |
| 3. Your Choice, you can either sell one of your investments at cost to the bank or a neighbor that wants to buy it, or you can roll the dice again. |
| 4. Your Choice, you can move to the closes invest space to take advantage of that opportunity or you can pass up this turn and do nothing. |
| 5. Your choice, if you own any kind of stock you can sell it for twice its value or you can roll the dice again. |
| 6. Your Choice, if you own any emerald stones you may sell them for $2,000.00 cash or you may move to the closest disposable income space. |
| 7. Your Choice, go out to eat for $100.00 or sell one of your investments at cost to the bank. |
| 8. Your Choice, you have this opportunity to place $1,000.00 cash into a mutual fund or you can roll the dice again. |
| 9. Your Choice, you may sell your CD if you own one for cost or you may move to the closest disposable income space. |
| 10. Your Choice, you may move to the closest disposable income space or you may roll the dice again. |
| 11. Your Choice, you must make a loan to a family member of $500.00 cash, or you may move to the closest debt space on the board. |
| 12. Your Choice, you can put $800.00 on your credit card towards the purchase of a used car or you may move to the closest debt space on the board. |
| 13. Your Choice, please move the closest invest space on the board or pull the next choice card. |
| 14. Your Choice, you may move ahead 12 spaces on the board or you may roll the dice again. |
| 15. Your Choice, you have received a gift from a relative of 10 CDs valued at $200.00 per CD, or you can receive a gift of cash from your relative valued at $1,000.00. |
| 16. Your Choice, You have had a family emergency, you must pay $800.00 for hospital bills or you may sell an investment at cost to pay for the hospital bill. |
| 17. Your Choice, you must get a player to sell you one of their investments at cost or you must move to the closest debt space. |
| 18. Your Choice, you must pay the bank back a $400.00 loan in cash or you must move the closest debt space. |
| 19. Your Choice, you must sell one of your investments to any player at cost or you must move to the closest debt space. |
| 20. Your Choice, you must roll the dice again or select another choice card. |
| 21. Your Choice, purchase a mutual fund for $500.00 or please move to the next disposable income space. |

TABLE V-continued

| Your Choice (55) Cards |
|---|
| 22. Your Choice, if you have any money in a mutual fund you add additional moneys up to $500.00 to the account or you may move to the closest invest space on the board. |
| 23. Your Choice, if you own any bonds you may sell them for their value at cost or you may roll the dice again. |
| 24. Your Choice, if you have $1,500.00 cash on hand you may subtract $200.00 from your credit card debt or you may move to the closest invest space. |
| 25. Your Choice, if you own any stock you may sell it for twice its value, or if you own a money market fund and you have cash on hand you may put additional moneys into your money market fund up to $1,000.00. |
| 26. Your Choice, Bad news! Your best friend needs an emergency operation you must pay $2,000.00 cash or you may put $2,000.00 cash onto your credit card if you do not have the total amount in cash available. |
| 27. Your Choice, Great News! Your grandmother has given you a rare antique painting the appraised value is $1,200.00 you may add this to your asset list or you may sell this asset at a value of $800.00 to get rid of credit card debt. |
| 28. Your Choice, Bad News! Your spouse has broken their arm and will be out of work for the next 2 months, you will have to miss a two turns or you will not be able to collect the next four disposable income spaces. |
| 29. Your Choice, if you own any bonds you may sell them at cost to pay down on credit card debt or you must roll the dice again. |
| 30. Your Choice, if your credit card balance it above $2,000.00 you must pay $200.00 in cash to the bank for late fees or you can move to the closest debt space on the board. |
| 31. Your Choice, if you own any land you may sell it to the bank at double its value or you may keep the investment and receive $500.00 from the bank in royalties. |
| 32. Your Choice, if you own a mutual fund receive half of its value in cash or you may move to the closest invest space. |
| 33. Your Choice, if you have credit card debt pay half of its value or pay $300.00 to roll the dice again. |
| 34. Your Choice, if you have any credit card debt please pay the bank $500.00 or move to the closest debt space on the board. |
| 35. Your Choice, Bad News!! Your car was totaled in an accident you must pay $3,000.00 to the bank for a new car or sell $2,500.00 of your investments. |
| 36. Great News!! You turned in a wallet you found on the street, receive $500.00 cash as a reward or move to the closest investment space. |
| 37. Your Choice, subtract $800.00 from your credit card statement due to clerical error or you may add $500.00 to your investment balance in the form of a savings account. |
| 38. Your Choice, if you own any land you may sell it for twice its value or you may buy and additional acre of land for $1,000.00. |
| 39. Your Choice, if you own any stock you may sell it for twice its cost or you may open a savings account for $800.00. |
| 40. Your Choice, if you own a mutual fund you may sell it for half its value or you may move to the closest debt space on the board. |
| 41. Your Choice, move to the closest debt space on the board or you must pay $500.00 if you have a credit card balance. |
| 42. If you own any bonds you may sell them at twice their value or you may roll the dice again. |
| 43. Your Choice, if you own any bonds you may sell them for twice their value or you may buy 3 additional bonds for $500.00 a piece. |
| 44. Your Choice, if you own an annuity you may sell it at cost or you can purchase an additional annuity for $500.00. |
| 45. Your Choice, if you own a mutual fund you may sell it at twice its value or you may invest $800.00 into an additional mutual fund. |
| 46. Your Choice, if you own stock you may sell it at twice its value or you may make additional stock purchases of 5 shares at $200.00 per share. |

TABLE V-continued

| Your Choice (55) Cards |
|---|
| 47. Your Choice, you must pay $200.00 for past due credit card fees or roll the dice again. |
| 48. Your Choice, you can move to the closest disposable income space or roll the dice again. |
| 49. Your Choice, you can move to the closest debt space or pay $300.00 to roll the dice again. |
| 50. Your Choice, you may sell one of your investments to a player of your choice or you must move to the closest debt space on the board. |
| 51. Your Choice, if your credit card balance is below $500.00 you may receive $100.00 from the bank or move to the closest disposable income space. |
| 52. Your Choice, if your credit card balance is above $1,000.00 you must pay $800.00 in fees or you may sell one of your investments to the bank. |
| 53. Your Choice, if you investments balance is above $8,000.00 you must pay $1,000.00 in commission fees or you can move to the closest debt space on the board. |
| 54. Your Choice, if your investment balance is above $4,000.00 you must sell one of your investments to the bank at its original cost or you must add $1,500.00 to your credit card statement due to a clerical error. |
| 55. Your Choice, move to the closest invest space or move to the closest disposable income space. |

© 2003 Mechel Glass

The game preferably ends when one player meets two conditions: (1) The player must have a credit card balance of zero, and (2) they must have assets of at least $10,000.

It is envisioned that, in an alternative embodiment, the instant invention could be played in electronic form with electronic dice, asset and credit card debt tracking, and scoring.

A further alternative embodiment would provide for the use of currencies of countries other than the United States, allowing game play in the currency that the player is familiar with.

It is contemplated in yet another alternate embodiment that the game may be tailored to teach credit card debt management to specific, or targeted, socioeconomic groups for educational purposes, and for assistance in reducing credit card debt in general for such groups.

It is envisioned in another alternative embodiment that game play time may be shortened or extended by varying the requisite amount of assets to end the game.

Figure 4:
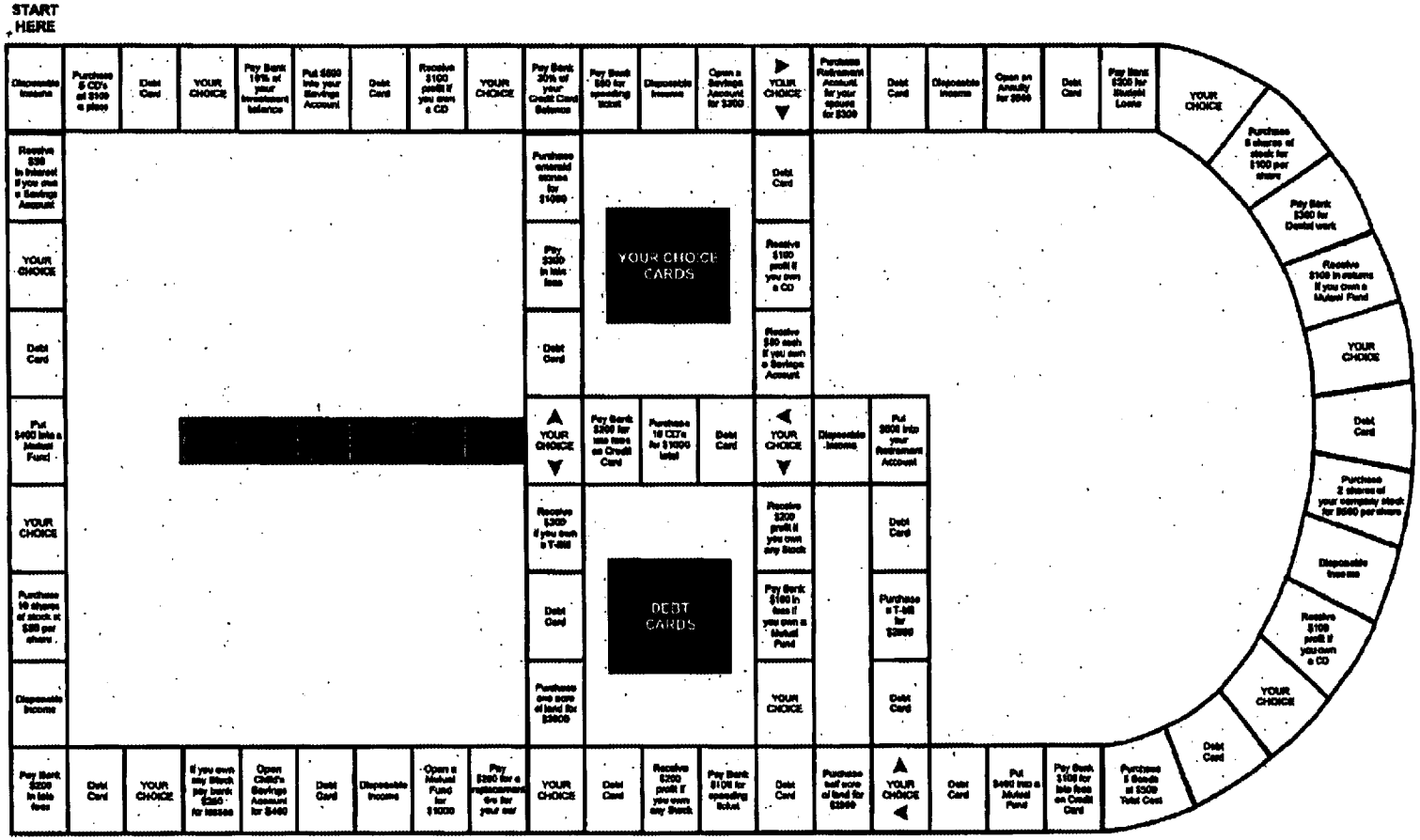
Figure 5:
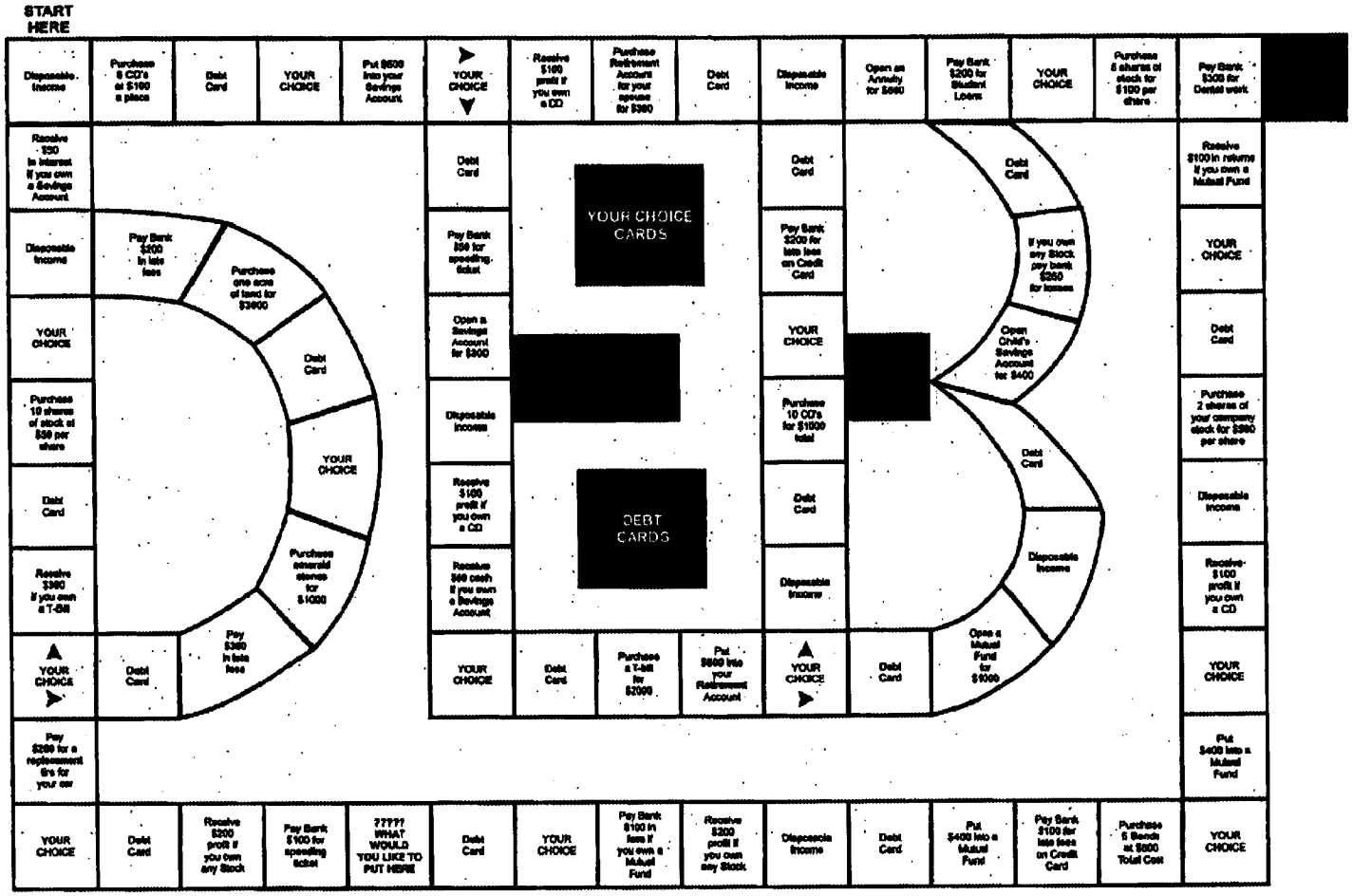

FIGS. 4 and 5 depict alternative embodiments of the present invention, in which different pathways from that of the preferred embodiment are shown. It is envisioned that any number of different, yet equivalent, schemes for alternate pathways may be developed with a different number of spaces, and further that the positioning of the various actions, as listed on the spaces of FIGS. 4 and 5, could be placed in any number of different locations within the pathway.

Having thus described exemplary embodiments of the present invention, it should be noted by those skilled in the art that the within disclosures are exemplary only, and that various other alternatives, adaptations, and modifications may be made within the scope of the present invention. Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation. Accordingly, the present invention is not limited to the specific embodiments illustrated herein, but is limited only by the following claims.

What is claimed is:

1. A game for teaching management of credit card debt comprising:

a board with at least one path thereon, said path having spaces thereon that describe actions to be undertaken by a player of said game, wherein said actions comprise payment of credit card interest and payment of credit card late fees, and wherein a plurality of spaces comprise receipt of disposable income;

cards describing debt required to be undertaken by said player;

cards describing choices between alternative game management activities to be taken by said player, wherein one of said alternative choices comprises payment of credit card late fees;

game piece means for distinguishing between players and for marking each of said players' current position on said path;

means for determining movement of said game piece;

means for keeping score; and means for determining different starting amounts of credit card debt and cash, wherein players randomly determine said amounts of credit card debt and cash for each said player to begin said game, whereby said game allows decision-making and thus teaches said players methods of control and elimination of their own real credit card debt.

2. The game of claim 1, further comprising variant pathways that said players may select to follow.

3. The game of claim 1, wherein said means for determining movement of said game piece is a pair of dice.

4. The game of claim 1, wherein said game management activities are selected from the group consisting of asset accumulation, asset reduction, debt accumulation, debt reduction, re-rolling dice, receiving income, losing income, spending, moving to another space, doing nothing, and taking a new card.

5. The game of claim 4, wherein said spending comprises payment of expenses first from cash on hand, and only after said cash on hand has been expended, by incurring additional credit card debt.

6. The game of claim 1, wherein said means for determining movement of said game piece is an electronic counter capable of generating a randomly selected number.

7. The game of claim 1, wherein said means for keeping score is a scorecard upon which scores may be written.

8. The game of claim 7, wherein said scorecard has thereon a location for listing credit card debt and investment values.

9. The game of claim 1, wherein said credit card late fees are only required to be paid if said player has credit card debt acquired during said game.

10. A method for teaching management of credit card debt comprising the steps of:

a) providing a game having alternative path choices required to be made by players of said game, wherein said game comprises;

a board with at least one path thereon, said path having spaces thereon that describe actions to be undertaken by a player of said game, wherein said actions comprise payment of credit card interest and payment of credit card late fees, and wherein a plurality of spaces comprise receipt of disposable income;

cards describing debt required to be undertaken by said player;

cards describing choices between alternative game management activities to be taken by said player, wherein at least one of said alternative game management activity choices comprises payment of credit card late fees;

game piece means for distinguishing between players and for marking each of said players' current position on said path;

means for determining movement of said game piece; and means for keeping score, wherein said alternative path choices comprise selection between a shorter high risk/high reward path and a longer moderate risk/reward path, and wherein players start the game with different amounts of credit card debt and different amounts of cash, and wherein said different amounts of credit card debt and said different amounts of cash are randomly determined by roll of a die;

b) joining said players to play said game; and c) playing said game.

11. The method of claim 10, wherein said alternative game management activity choices are whether to increase credit card debt or to use cash on hand to pay expenses.

12. The method of claim 10, further comprising the step of rolling a pair of dice to advance along a path marked on a game board.

13. The method of claim 12, further comprising the steps of selecting activity cards in response to instructions located on spaces on said path, and carrying out said instructions.

14. The method of claim 13, further comprising the step of keeping score of credit card debt and investment values.

15. The method of claim 14, wherein the winner among said players is the first to achieve zero credit card balance and a selected investment sheet value.

16. The method of claim 10, wherein players must completely eliminate their credit card debt to win the game.

17. A method for learning to manage credit card debt comprising the steps of:

a) starting a game wherein each player has cash assets and credit card debt randomly determined, wherein said game comprises a board, cards, a path, means for determining movement of a game piece arid means for keeping score, and wherein said random determination of assets and credit card debt is simultaneous;

b) playing said game by requiring choices between randomly selected spending or investment alternatives; and c) winning said gain by completely eliminating credit card debt.

18. The method of claim 17, wherein said step of playing said game by requiring choices between randomly selected spending or investment alternatives, further comprises a prohibition against making an investment exceeding funds on hand and a prohibition against making an investment if credit card debt exceeds a selected level.

19. The method of claim 17, further comprising the step of:

rolling a die for said each player to determine a level of cash and a level of credit card debt that said each player will have to begin said game.

* * * * *